United States Patent [19]

Schmidt et al.

[11] 4,232,974

[45] Nov. 11, 1980

[54] MEANS FOR THE PRODUCTION OF A MULTI-COMPONENT PLASTICS MATERIAL

[75] Inventors: Ludwig Schmidt, Dortmund; Werner Wellie, Essen, both of Fed. Rep. of Germany

[73] Assignees: Ruhrkohle, A.G.; Schaum-Chemie W. Bauer K.G., both of Essen, Fed. Rep. of Germany

[21] Appl. No.: 25,364

[22] Filed: Mar. 30, 1979

Related U.S. Application Data

[63] Continuation-in-part of Ser. No. 800,224, May 25, 1977, abandoned.

[30] Foreign Application Priority Data

Jun. 2, 1976 [DE] Fed. Rep. of Germany ..... 2624752

[51] Int. Cl.[3] ..... B01F 15/04

[52] U.S. Cl. ..... 366/162

[58] Field of Search ..... 366/150, 160, 179, 162, 366/152, 161; 417/234, 338, 342, 426

[56] References Cited

U.S. PATENT DOCUMENTS

| | | | |
|---|---|---|---|
| 3,013,497 | 12/1961 | Schneider | 417/426 |
| 3,232,585 | 2/1966 | Garbarino | 366/160 |
| 3,857,550 | 12/1974 | Knipp | 366/179 |

FOREIGN PATENT DOCUMENTS

| | | | |
|---|---|---|---|
| 1322050 | 7/1973 | United Kingdom | 366/179 |

*Primary Examiner*—Robert W. Jenkins

*Attorney, Agent, or Firm*—Andrus, Sceales, Starke & Sawall

[57] ABSTRACT

Foam generating equipment for use in mines includes supply vessels for the resin and foaming agent located in a central stores location. An air compressor is also located there. A pair of pumps in a protective casing transportable by an operator have inputs receiving the resin and foaming agent and outputs connected to a foaming gun. The pumps have a common power supply connection coupled to the air compressor. The pumps in the casing are carried by the operator and deposited at a temporary location in proximity to the site where the foam is to be emplaced. The spray gun is then operated to emplace the foam at the site.

5 Claims, 3 Drawing Figures

MEANS FOR THE PRODUCTION OF A MULTI-COMPONENT PLASTICS MATERIAL

CROSS-REFERENCE TO RELATED APPLICATION

The present application is a continuation-in-part of U.S. Patent Application Ser. No. 800,224, filed May 25, 1977 now abandoned.

BACKGROUND OF THE INVENTION

1. Field of the Invention

The present invention relates to apparatus for producing multi-component plastic foam for use in undergound coal mining, particularly for fire fighting.

2. Background of the Invention—Description of the Prior Art

Foam generating apparatus is used in underground mines to improve fire prevention capabilities. The foam can be employed for closing off cavities through which firedamp (methane) is emerging, which could otherwise cause spontaneous combustion of coal. This is particularly important in the case of abandoned galleries, as there is always enough coal remaining for spontaneous combustion to occur, so long as sufficient oxygen is available. Cavities caused by roof falls or produced during the driving of galleries can also be filled using such means, to avoid the development of pockets of firedamp and other dangerous gases.

Closing off with plastic foam is considerably more cost and time saving than using rubble or other materials. On the other hand, because of the relatively high cost of plastics, the filling of such cavities is restricted to those which are not constantly swept through and kept clear by passing air current.

The components of the foam, typically a resin and a foaming agent, are withdrawn from storage vessels and provided to a spray unit by means of compressed air and pipelines. The components are mixed and distributed by the spray unit to seal off the cavity.

Unitary foaming apparatus incorporating the storage vessels, air compressor, pumps, and spray gun in a single unit tends to be so large and bulky that its utilization in mines is restricted because of the small spaces occurring in many places in the mine. This is a serious limitation because fire hazards which the foam barricades protect against often occur in such small spaces.

For this reason, foaming apparatus has been developed employing pumps which may be individually carried to the site. With the usual two-component plastic foam, two separate pumps are necessary, one for withdrawing the resin and the other for withdrawing the foaming agent from the storage vessels. The pumps deliver the resin and foaming agent to the spray unit which is of pistol-like form. While this permits more widespread use of the foam generating equipment, the time necessary to connect the pumps, material containers, air compressors, spray unit, etc. together greatly reduces the rapidity with which the foam can be emplaced, particularly in view of the cramped spaces, high temperature, dust, and darkness of the mine. On account of the same reasons, and because of the complexity of the equipment, the danger of accidental interchange of the components, particularly the pumps, is also quite high. This leads to considerable contamination or even damage to the pumps which can then only be used again after a thorough cleaning.

So far, such a plant can not be carried and operated by one man alone, although it can be broken down into individual portable parts and accessories. The weight of such plants amounts to around 12 kg. Thus, one man can only carry one pump in each hand and a second man must carry and operate the accessory parts, i.e. the pipes, the spray unit, and the containers for the resin and foaming agents.

SUMMARY OF THE PRESENT INVENTION

The present invention provides a means which retains the advantages of both unitary foaming apparatus and component foaming apparatus while avoiding their disadvantages. The equipment may be easily and quickly put into service with very little likelihood of accidental interchange of components. The equipment is also suitable for use in restricted areas and may be carried and operated by one man.

To these ends, the present invention provides a foam generating apparatus for generating a multi-component foam at a predetermined location in a mine in which the supply vessels for the foam components are located at a central stores location remote from that at which the foam will be emplaced. The location may typically be adjacent the shaft of the mine. A fluid power source, such as an air compressor, is also located at the central location. A pump unit transportable by an operator includes a pair of independently operable pumps. The pumps are detachably received within a protective casing adapted to be carried on the back of the operator. The pumps have inputs by which the components of the foam are separately delivered to a foam applying means, such as a spray gun. With the pumps mounted in the casing, the input and output connection of both pumps are easily made in an orderly manner. Inadvertant interchange between the pumps during connection of the elements of the foam generating apparatus is minimized. A common power supply connection to the air compressor is provided. This also facilitates the connection of the elements of the foam generating apparatus.

In use, the casing with its pumps is carried on the back of the operator to a temporary location in proximity to the site of foam emplacement. The casing is then hung up, for instance on the prop or a roof support. The pump means is connected to the supply vessels, air compressor, and spray gun. The operator then approaches the site at which foaming is to be carried out and applies the foam to provide a barricade or other fire protective structure.

The common power supply connection to the pumps insures that both pumps are constantly subjected to the same pressure. Thus the pumps operate in constant dependence on each other so that the components are delivered in acurately maintained proportions to the spray fitting. For this reason, a very even mixture emerges from the spray unit.

The detachable fastening of the pumps in the casing facilitates replacement of the pumps and may be formed so that it protects both pumps in the portable casing from shock and slipping.

The casing is conveniently designed to be carried by one man. Because of the restricted circumstances below the ground, carrying on the back of the man is particularly suitable. Thus, according to a preferred feature of the invention, the casing is shaped to match the shape of the pumps and is formed from sheet metal as a rucksack with carrying straps. Preferably the metal is a light metal or alloy. The casings may be of the kind used, for example, for the circulation devices employed by the mines protection services so that the old casings from such devices can be utilized for the acceptance and transportation of the pumps. A sheet or light metal casing of this kind protects the pumps and auxiliary equipment from damage and dirt. By using the carrying straps, the plant can be practically and easily carried on the back of one man.

The casing is preferably provided with a suspension device for hanging the casing on stationary support means, for example, on the side of the gallery, on props, or other parts of the lining. This also has the advantage that the casing is protected from being knocked over or other damage.

The pumps are taken back, after use, to the central stores area and, if necessary, cleaned there. In order to facilitate this work and enable replacement of the pumps, according to a further feature of the invention, the pumps are fastened in the casing by means of clamping bands which can be released at one or both sides. The clamping bands can be of metal or other resilient material.

As a further simplification and improvement of the foam generating equipment, a lead off is further provided at the power supply connection so that compressed air can be fed directly through the spray gun for increasing the ejection speed of the foam. A regulating valve may also be provided for controlling the air pressure.

BRIEF DESCRIPTION OF THE DRAWING

An embodiment of the invention will now be described, by way of example, with reference to the following drawings, in which.

DETAILED DESCRIPTION OF THE PREFERRED EMBODIMENT

Figure 1:
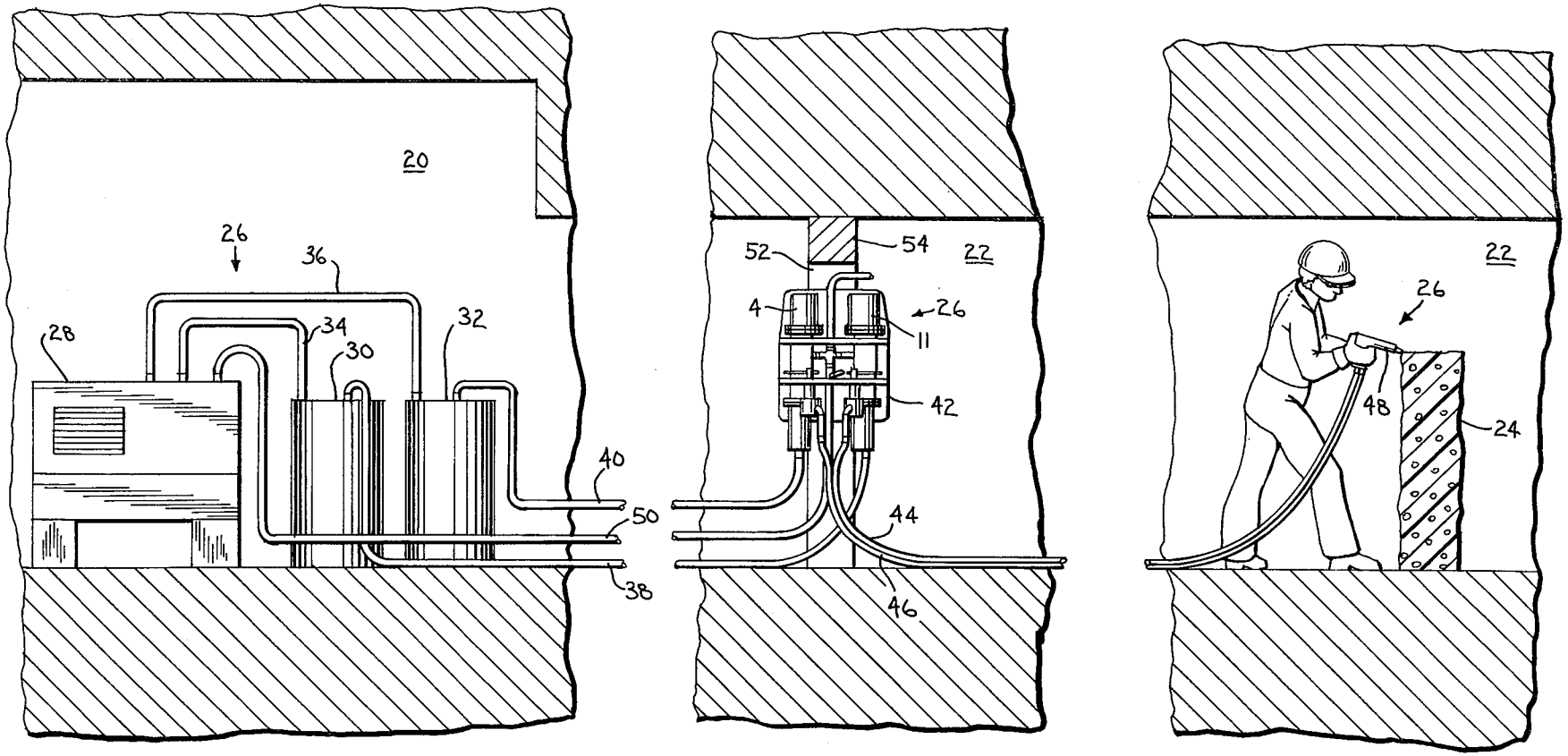
FIG. 1 is a perspective view showing the foam generating apparatus of the present invention in use in a mine.

FIG. 1 shows a coal mine having a central work area 20 which may be adjacent the main shaft of the mine. Gallery 22 of restricted dimension extends off central work area 20. It is desired to seal off the end of gallery 22 by means of a foam barricade 24 to prevent the generation of fire damp in the end of the gallery and its supply to the remaining portions of gallery 22 and central work area 20. The plastic foam of barricade 24 is typically formed as a result of mixing a resin and a foaming agent.

Plastic foam generating apparatus 26 is used to form barricade 24. Foam generating apparatus 26 includes a fluid power source, such as air compressor 28, located in central work area 20. Supply vessels 30 and 32 for the resin and foaming agent, respectively, are also located in central work area 20. Vessels 30 and 32 each have a capacity of around 30 liters. Supply vessels 30 and 32 may be pressurized by air compressor 28 through hoses 34 and 36 to assist in supplying the resin and foaming agent in feed lines 38 and 40.

Pump unit 42 of foam generating apparatus 26, hereinafter described in detail, includes foaming agent pump 4, connected to feed line 40 and resin pump 11 connected to feed line 38. The output of pump unit 42 is provided to supply lines 44 and 46 and to spray gun 48. The resin and foaming agent are mixed in spray gun 48 and discharged to form barricade 24. The pumps are driven by compressed air in air hose 50.

Turning now specifically to pump unit 42, two pump units 4, 11 are arranged in a casing 1. The pumps 4, 11 are held by clamping bands 2, 9, which can be releasably connected to the casing 1 by any suitable means, for example, by a simple socket connection or by a spring safety hook (not shown).

The pumps 4, 11 withdraw the desired components by way of a foaming agent suction hose connection 5 or a resin suction hose connection 8, respectively, connected to feed lines 40 and 38, respectively. Compressed air from air compressor 28 and air line 50 is fed into a compressed air connection 10 and operates the pumps which then force the components to spray gun 48 by way of a foaming agent hose connection 6 and a resin hose connection 7. Additionally, compressed air can be fed directly through the lead-off 3 and hose 52 to the spray gun 48.

In the embodiment shown in FIG. 1, there is sufficient space remaining in the casing for the spray gun 48 as well as a part of the hoses 44, 46 to be stored therein.

Figure 2:
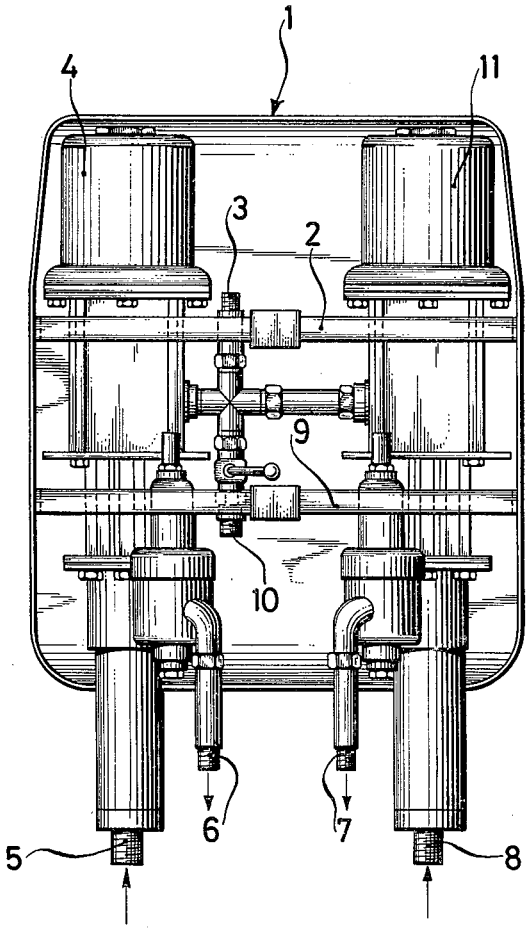
FIG. 2 is a rear view of the pump element of the foam generating apparatus.
Figure 3:
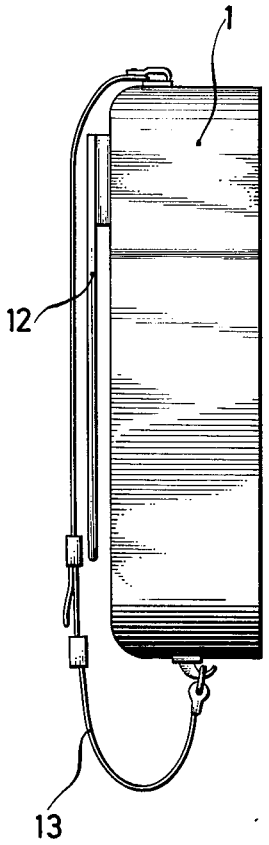
FIG. 3 is a side view of the pump element.

FIG. 2 shows a side view of the casing 1 in which carrier straps 13 and a suspension device 12 are depicted.

In use, the operator assembles his equipment in central work area 20. When complete, he places pump unit 42 on his back, as by straps 13, and enters gallery 22. He advances along gallery 22, laying down feed lines 38 and 40 and air hose 50 as he proceeds. When he reaches a convenient location in proximity to the site where barricade 24 is to be formed, he stops, removes pump unit 42 from his back and hangs it on a convenient structure, such as roof support 54 by suspension device 12. Feed lines 38 and 40 are then connected to inlet fittings 8 and 5 and air hose 50 is connected to fitting 10. Spray gun 48 and supply lines 44 and 46 are removed from housing 1. If not already connected, supply lines 44 and 46 are connected to connectors 6 and 7 and valve 56 opened to commence operation of pumps 11 and 4. The operator then positions himself at the site where barricade 24 is to be erected and operates spray gun 48 to mix the resin and foaming agent and dischange the mixture to form barricade 24.

When the formation of barricade 24 is complete, spray gun 48 and hoses 44 and 46 are returned to casing 1. Feed lines 38 and 40 and air hose 50 are disconnected. Pump unit 42 is placed on the back of the operator and returned to central work area 20 for cleaning and storage.

Various modes of carrying out the invention are contemplated as being within the scope of the following claims particularly pointing out and distinctly claiming the subject matter which is reagarded as the invention.

We claim:

1. Foam generating apparatus for producing multicomponent foam at a predetermined site in an underground mine comprising:

supply vessels for at least first and second components of the foam located at a generally fixed location remote from said predetermined site;

a fluid power source located at a generally fixed location remote from said predetermined site;

conduits connected to each of said supply vessels and fluid power source;

a pump means transportable by an operator to a temporary location in proximity with said predetermined site, said pump means comprising a protective casing adapted to be carried on the back of said operator, a plurality of independently operable pumps detachably received within said casing for being protected by same when in use in the mine, said pumps having inputs connected to said supply vessel conduits by which the components of the foam are separately received from said supply vessels and outputs by which the components are separately delivered, and a common power supply connection connected to said fluid power source conduit for driving said pumps; and foam applying means having conduit means coupled to the outputs of said pumps for conveying the components to said predetermined site, said foam applying means mixing said components and applying same at said predetermined site to form said foam.

2. The foam generating apparatus according to claim 1 wherein the shape of the casing is matched to the shape of the pumps and the casing is formed as a rucksack with carrier straps.

3. The foam generating apparatus according to claim 1 wherein the casing includes a suspension device for hanging the casing on stationary support means in the mine.

4. The foam generating apparatus according to claim 1 wherein the pumps are fastened in the casing by means of clamping means which can be released at at least one end.

5. The foam generating apparatus according to claim 1 wherein an air hose lead off is provided at the common power supply connection.

* * * * *